US006505370B2

(12) United States Patent
Sharp et al.

(10) Patent No.: US 6,505,370 B2
(45) Date of Patent: Jan. 14, 2003

(54) LOAD ADAPTIVE BRAKE SYSTEM FOR AUTOMATIC WASHER

(75) Inventors: Brenner M. Sharp, Bridgman, MI (US); Pierre Bayle, St. Joseph, MI (US); Michael T. Farrington, St. Joseph, MI (US); Kenneth A. Lahrman, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 130 days.

(21) Appl. No.: 09/800,037

(22) Filed: Mar. 6, 2001

(65) Prior Publication Data

US 2002/0124328 A1 Sep. 12, 2002

(51) Int. Cl.[7] ..... D06F 37/40

(52) U.S. Cl. ..... 8/159; 68/23.6; 188/166; 188/325

(58) Field of Search ..... 8/159; 68/23.6, 68/23.7; 188/166, 325, 332, 333

(56) References Cited

U.S. PATENT DOCUMENTS 2,639,618 A * 5/1953 McNairy ..... 68/23.7 X
2,845,156 A * 7/1958 Dayton ..... 68/23.7 X
2,946,409 A * 7/1960 Jennings ..... 68/23.7 X
4,254,641 A 3/1981 Gauer et al. ..... 68/23.7
4,387,580 A * 6/1983 Kennedy et al. ..... 68/23.7
5,460,018 A 10/1995 Werner et al. ..... 68/23.6
5,491,859 A * 2/1996 Richardson ..... 68/23.7 X
6,115,863 A 9/2000 Mason et al. ..... 8/159

* cited by examiner

*Primary Examiner*—Philip Coe
(74) *Attorney, Agent, or Firm*—Thomas J. Roth; Robert O. Rice; Stephen Krefman

(57) ABSTRACT

A load adaptive brake system is provided for an appliance which includes a motor, a drive wheel driven by the motor and a rotatable vessel. A brake surface is fixed relative to a non-movable portion of the appliance and at least one brake shoe carried by the vessel to rotate with the vessel. A biasing mechanism is engageable with the brake shoe to press the brake shoe into engagement with the brake surface. A cam is carried on the vessel, but is rotatable with respect thereto, and engageable with a portion of the brake shoe to overcome a bias of the biasing mechanism when the cam is rotated relative to the vessel in a first direction to disengage the brake shoe from the brake surface. A coupling mechanism is arranged between the drive wheel and the cam to selectively couple the motor to the vessel by rotation of the cam in the first direction when the drive wheel is rotating in one direction relative to the cam and to uncouple the motor from the basket when the drive wheel is rotating in a second, opposite direction relative to the cam.

21 Claims, 8 Drawing Sheets

LOAD ADAPTIVE BRAKE SYSTEM FOR AUTOMATIC WASHER

BACKGROUND OF THE INVENTION

The present invention relates generally to washing machines and more particularly to a brake system for a washing machine or other appliance that can adapt to the size of the load held within the machine.

Vertical axis washing machines include a wash basket that spins about a vertical axis. Horizontal axis washing machines include a wash basket that spins about a horizontal axis. Other washer constructions have a tilted axis between vertical and horizontal. During a spin cycle following a rinse cycle, the wash basket spins at a fairly high rate of speed in order to extract water from the clothing that has been rinsed. Conventional vertical axis washing machines typically spin at a rate of about 600 to 650 revolutions per minute (RPM) or more.

Underwriters Laboratories (UL) require that, when a washing machine lid is opened during the spin portion of a cycle, the basket must stop spinning within 7 seconds. A brake mechanism is therefore required in order to slow down the rapidly spinning basket within this 7 second time interval. For conventional vertical axis washing machines, the brake mechanism typically applies the same braking pressure to the wash basket at any speed and for any wash basket load. This static or standard brake pressure has been satisfactory for the slower spin rate of these conventional machines.

However, new generations of washing machines are on the horizon that can spin the wash basket during a rinse cycle at much greater speeds, such as on the order of about 800 or greater RPM. The load required to slow and stop the wash basket within the 7 second interval is much greater at these higher rotational speeds. However, when a high braking load is applied to a wash basket that is spinning at this much higher rate and that contains a very light laundry load it produces undesirable consequences. For example, if a light load is held within the basket spinning at about 500 RPM, when the heavy brake load is applied, the washing machine components begin to vibrate and begin to cause significant noise, vibration and even movement or walking of the machine. At a minimum such conditions are unpleasant and could potentially cause more serious consequences.

Where a washing machine brake is incapable of meeting this 7 second requirement, a lid lock must be employed to prevent access to the wash drum until it has stopped spinning. Such a lid lock adds expense to the machine and creates a significant inconvenience to users.

SUMMARY OF THE INVENTION

In light of the above noted problems, it is an object of the present invention to provide a washer brake mechanism that applies sufficient brake torque for these relatively high RPM machines, but not the same brake torque under all washer conditions. It is another object of the present invention to provide a brake mechanism that does not produce a constant high brake torque that would be sufficient to brake a fully loaded basket of wet laundry and yet which would overpower a lightly loaded basket. It is a further object of the present invention to provide a washer brake mechanism that produces a variable brake torque sufficient for different laundry loads. It is yet another object of the present invention to provide a washer brake mechanism that applies a brake torque that is variable according to particular laundry basket conditions. It is another object of the present invention to provide a load adaptive washer brake mechanism that automatically adjusts the applied brake torque according to the mass of the load held within the wash basket and the rotational speed of the basket.

It is another object of the invention to provide a load adaptive brake system for an appliance in which a drive motor and the rotatable vessel are selectively coupled and uncoupled and a braking mechanism is selectively engaged and disengaged as the uncoupling and coupling occurs, respectively. It is a still further object of the invention to use the reactive force of the motor to disengage the braking mechanism if the rotating vessel is being slowed too quickly by the braking mechanism. A preferred embodiment of the invention is in a vertical axis washer, although the invention can also be used in horizontal and tilted axis washers as well as other appliances having a rotatable vessel.

These and other objects, features and advantages of the present invention are provided by a load adaptive brake system for an appliance according to the present invention. In one embodiment, the load adaptive brake system includes a stationary brake drum supported by the washing machine. The brake system also includes a brake plate and a pair of opposed brake shoes supported by the brake plate and including brake linings facing the brake drum. A spring is interposed between first ends of the brake shoes for forcing the brake pads against the brake drum. A cam is slidably carried on a rotary shaft of the washing machine and has a pair of cam surfaces. A roller is disposed on a second end of each of the brake shoes. Each roller bears against one of the cam surfaces of the cam. The cam surfaces each have a profile so that the cam will rotate to at least partly relieve brake pressure on the brake drum as the motor of the washing machine decelerates and applies residual deceleration torque through the motor armature to the cam if the motor is caused to decelerate faster than the normal uncoupled deceleration rate. That is, the motor has a normal deceleration rate when the motor is not coupled to the wash basket. This normal deceleration rate, in a preferred embodiment, is such that the motor would decelerate from full speed, at which the wash basket is rotating at least 500 rpm, and perhaps at 800 or greater rpm, to a stop condition in about 5½–6½ seconds.

The brake system was developed to be able to apply sufficient brake torque to stop a fully loaded wash basket from a full speed spin to a stopped condition in less than 7 seconds. When this same brake torque is applied to an empty wash basket, the basket is slowed from full speed to a stopped condition in about 2 seconds. While such a speed is well within the time requirements, such abrupt braking causes the entire washing machine to jerk and move about. If, however, the motor is coupled to the empty wash basket as the wash basket is being slowed down, the motor is caused to slow down faster than its normal deceleration speed, resulting in a reaction torque being developed by the motor and transmitted back to the cam, rotating the cam in a reverse direction to release the braking pressure of the brake pads against the brake drum. This causes a reduction in the net brake torque, thereby lengthening the time for the wash basket to come to a complete halt, would also prevent the machine from jerking and moving about. Since the motor naturally stops in less than 7 seconds, coupling the motor with the basket does not cause the coupled combination to stop in greater than 7 seconds because the reaction torque lessens as the stoppage rate approaches 5½ to 6½ seconds, and the lesser reaction torque becomes insufficient to overcome the strength of the spring through the cam, hence reapplying the brakes.

Thus, in a preferred embodiment, a mechanism is provided to automatically couple the basket to the motor if the basket is being slowed faster than the normal deceleration rate of the motor and to uncouple the motor from the basket if the basket is being slowed slower than the normal deceleration rate of the motor. The profile of the cam is selected such that the reaction torque enables the brakes to be at least partially released through rotation of the cam.

In another embodiment of the invention, a vertical axis washing machine includes a wash basket that is rotatable about a generally vertical axis. A rotary shaft is coupled to the wash basket and a motor is coupled to the rotary shaft for rotating the wash basket. A brake drum is stationary and supported by a portion of the washing machine. A brake plate supports a pair of brake shoes wherein the brake plate is carried by a portion of the rotary shaft of the washing machine and rotates relative thereto. A pair of brake shoes are supported by the brake plate wherein each brake shoe has a brake lining that can bear against the brake drum. A spring is interposed between first ends of the brake shoes that forces the brake linings against the brake drum. A cam is slidably carried on a portion of the rotary shaft and has a pair of cam surfaces. A pair of cam rollers are supported by respective second ends of the brake shoes. Each cam roller bears against a respective one of the cam surfaces of the cam. Each cam surface has a profile that is adapted to at least partly reduce the amount of brake pressure applied by the brake linings against the drum upon rapid deceleration of the motor through residual torques applied through the motor armature during rapid deceleration.

In another embodiment a load adaptive brake system is provided for an appliance which includes a motor, a drive wheel driven by the motor and a rotatable vessel. A brake surface is fixed relative to a non-movable portion of the appliance and at least one brake shoe carried by the vessel to rotate with the vessel. A biasing mechanism is engageable with the brake shoe to press the brake shoe into engagement with the brake surface. A cam is carried on the vessel, but is rotatable with respect thereto, and engageable with a portion of the brake shoe to overcome a bias of the biasing mechanism when the cam is rotated relative to the vessel in a first direction to disengage the brake shoe from the brake surface. A coupling mechanism is arranged between the drive wheel and the cam to selectively couple the motor to the vessel by rotation of the cam in the first direction when the drive wheel is rotating in one direction relative to the cam and to uncouple the motor from the basket when the drive wheel is rotating in a second, opposite direction relative to the cam.

These and other objects, features, and advantages of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

Figure 1:
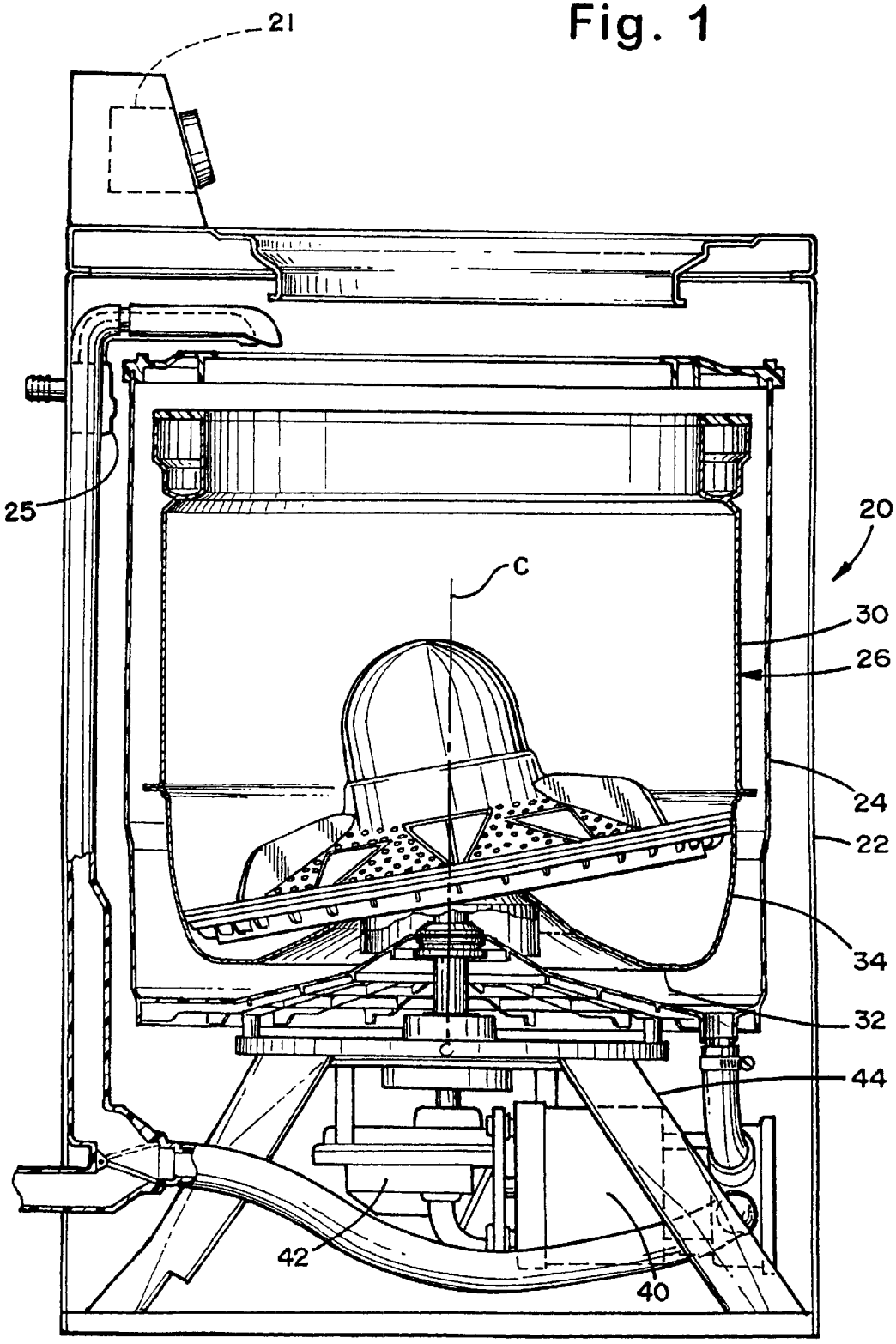
FIG. 1 is a side elevational view, partly in section, of a washing machine with a standard motor drive and showing the wash plate in an angled orientation.
Figure 2:
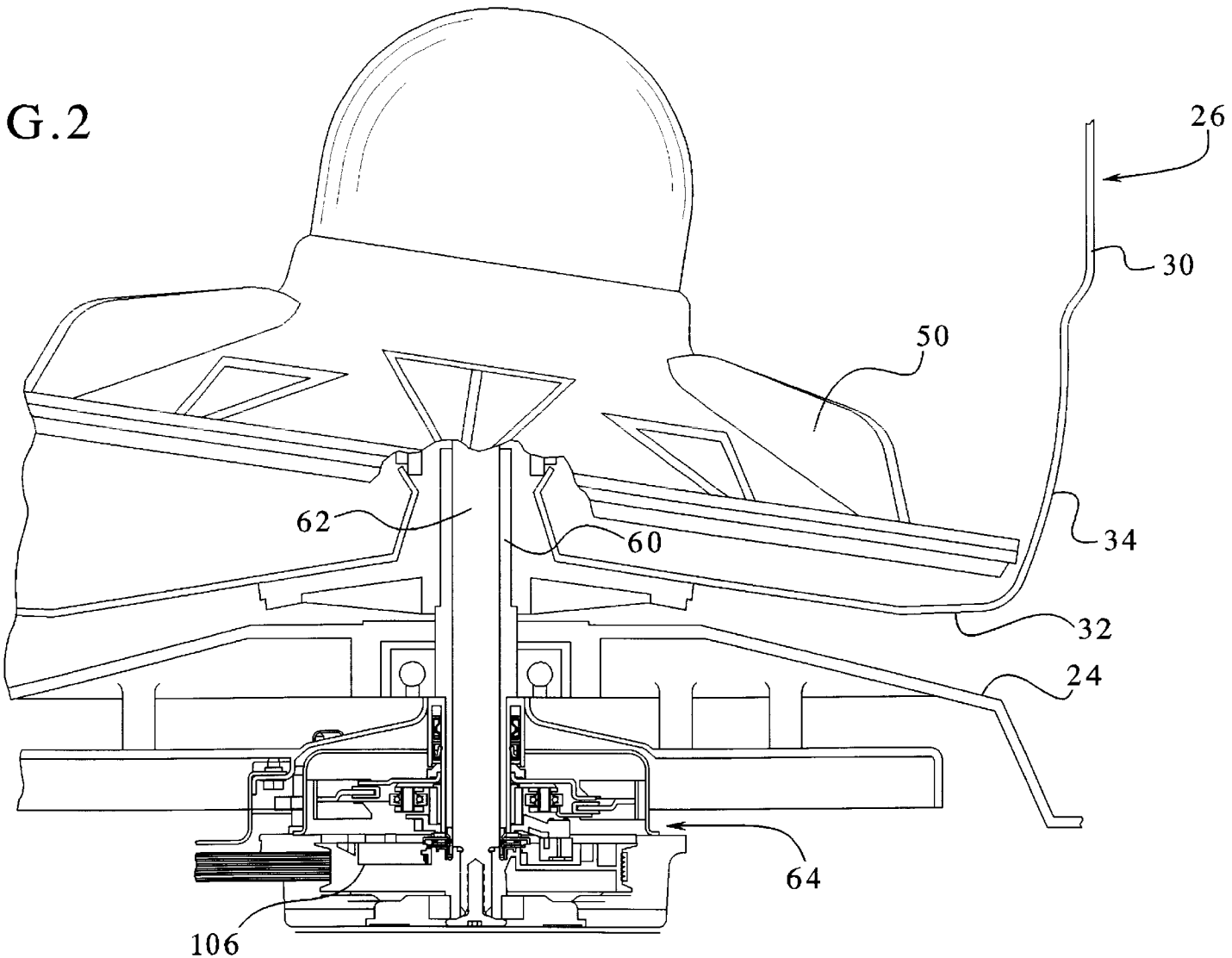
FIG. 2 is a detailed sectional view of the washing machine of FIG. 1 and including a brake mechanism constructed in accordance with the present invention.

The present invention is particularly useful for a vertical axis washing machine of the type disclosed in FIGS. 1–2 and thus the preferred embodiment will be disclosed in this environment, although the invention is not so limited. In fact, the present invention can be utilized in other types of washers such as horizontal axis or tilted axis, as well as any other appliance which has a motor driven rotatable vessel. This could include dryers, centrifuges and other appliances.

A particular type of vertical axis washing machine is disclosed in U.S. Pat. No. 5,460,018, the disclosure of which is hereby incorporated by reference. The type of machine disclosed therein includes an agitator or wash plate that can operate vertically and also operate at an angle. The wash plate is driven by a drive system that together can operate at significantly higher rotational speeds such as on the order of 500 RPM or more. The present invention is directed to a brake mechanism and system for stopping rotation of the wash basket (rotating vessel) when a lid is opened during the spin cycle. The brake mechanism of the present invention is load adaptive and applies a varying brake torque, dependent upon the mass of the laundry load within the wash basket.

In FIGS. 1 and 2, reference numeral 20 indicates generally a washing machine of the automatic type, i.e., a machine having a pre-settable sequential controller 21 for operating the washer through a preselected program of automatic washing, rinsing and drying operations in which the present invention may be embodied. The controller 21 may be an electromechanical timer type device or an electronic microprocessor. The machine 20 includes a frame or cabinet 22 surrounding an imperforate tub 24. A wash basket 26 with perforations or holes is rotatably supported within the tub and comprises a rotatable vessel into which a clothes load is placed. A fill valve 25 is connected to an external water supply (not shown) and is operated to inlet water into the tub. A hinged lid (not shown) is provided in the usual manner to provide access to the interior of the wash basket 26.

The wash basket 26 defines a wash chamber and includes a generally cylindrical side wall 30 having a vertical center axis C—C. The side wall 30 includes a partly spherical wall portion 34 adjacent a substantially flat bottom wall 32. A motor 40 is operatively connected to the basket 26 through a transmission 42 to rotate the basket 26 relative to the stationary tub 24. A suspension frame 44 supports the motor and tub assembly within the cabinet 22. The controller 21 is operatively interconnected with the motor and fill valve 25 such that the controller 21 can operate the washer 20 according to a selected program cycle.

The particular construction and operation of the agitation or clothes mover mechanism is not critical to the present invention, and could comprise one of many different constructions, such as those shown in FIGS. 1–2. The details of these constructions are known, for example as disclosed in U.S. Pat. Nos. 5,460,018 and 6,115,863 the full disclosures of which are incorporated herein by reference. Further details of the construction of those mechanisms is not included here, except to the extent necessary to describe the present invention.

Figure 3:
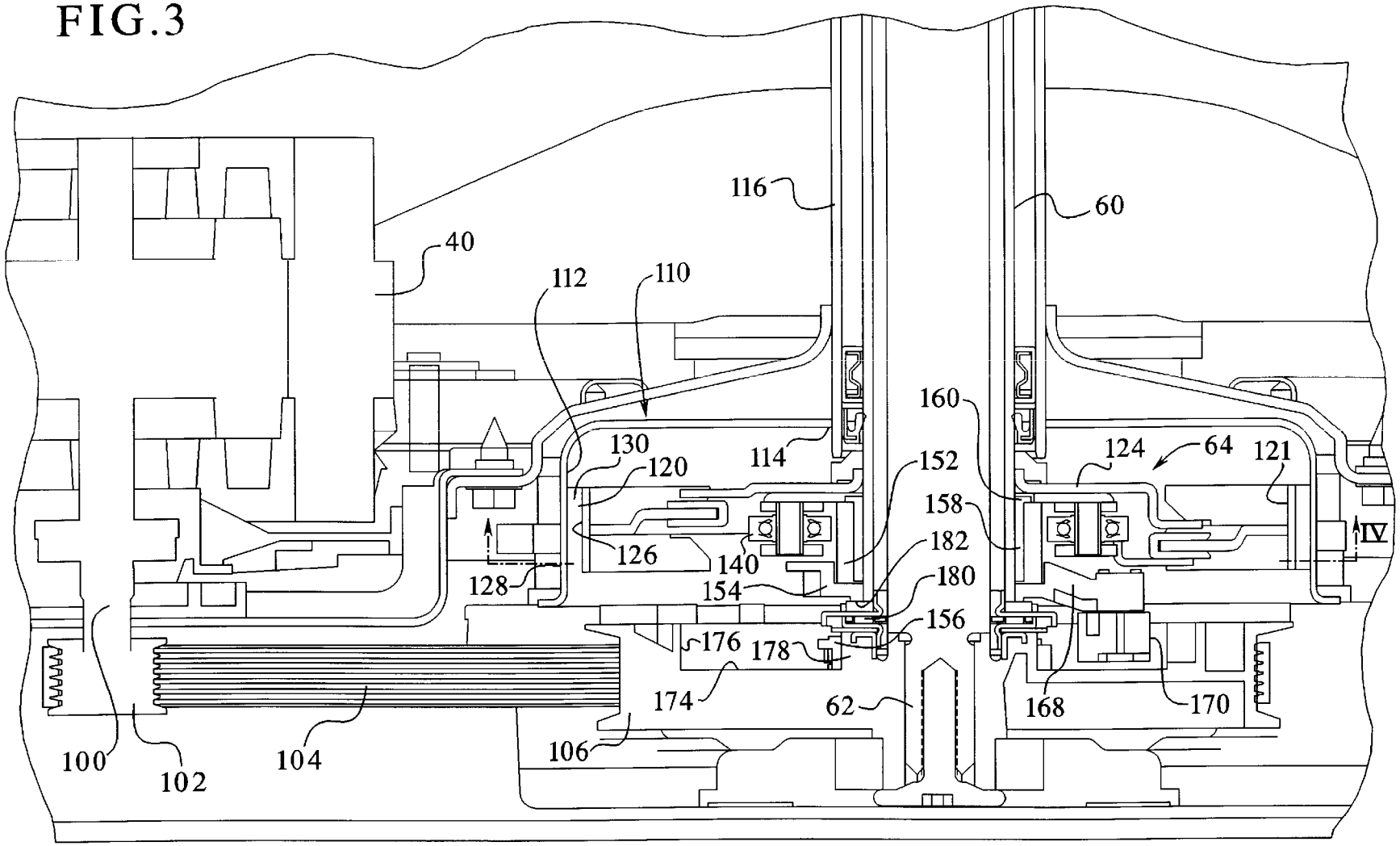
FIG. 3 is an enlarged view of the brake mechanism shown in FIG. 2.
Figure 4:
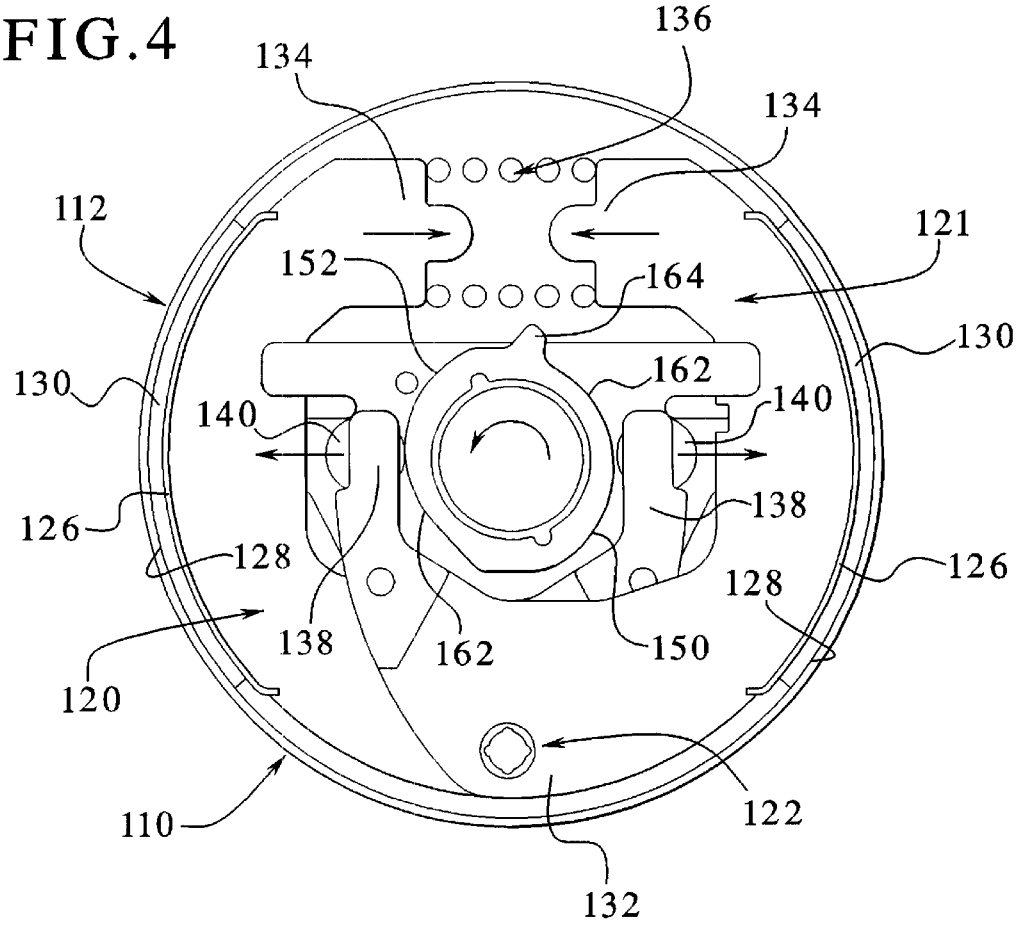
FIG. 4 is a cross section taken along line IV—IV of FIG. 3 illustrating the brake components.

A brake mechanism 64 embodying the principles of the present invention is shown environmentally in FIG. 3, and in greater detail in FIG. 4.

FIG. 3 illustrates a detailed cross section of a portion of the wash basket 26 and drive system including the load adaptive brake system or brake assembly 64 according to the present invention. The motor 40 includes a downwardly depending motor shaft 100 that includes a drive pulley 102 thereon. A belt 104 is coupled to the pulley 102 and is rotated by the pulley and motor shaft. The drive pulley, of course, could be replaced with some other type of drive wheel, such as a gear, driven through a gear connection to the motor shaft 100. The belt 104 is also wrapped around a larger diameter axial pulley 106 that is disposed adjacent the brake assembly 64. The axial pulley 106 is affixed to an output shaft 62 and rotates in conjunction therewith. The top end of the output shaft includes a splined end that is coupled to a portion of a drive hub so that an agitator or wash plate 50 also rotates in concert with the output shaft 62 and the axial pulley 106.

The brake assembly 64 is disposed adjacent the axial pulley 106 and concentric with the output shaft 62 and a spin tube 60 which is affixed to the wash basket 26. The brake assembly 64 includes a brake drum 110 defining a depending annular wall 112 that is concentric with the shaft 62 and the spin tube 60. The brake drum 110 is mounted fixed or stationary within the washing machine. In the present embodiment, the brake drum includes a central opening 114 that is fixed to a central stationary tube 116 that is also concentric with and houses the spin tube 60 and output shaft 62.

The brake assembly 64 preferably also includes a pair of brake shoes 120, 121 pivotally attached at a common pivot 122 to a stationary brake plate 124 (see also FIG. 4), although a single brake shoe could be utilized, or a number of brake shoes greater than two could also be utilized. The brake plate 124 and brake shoes 120, 121 in the present embodiment are arranged generally horizontally relative the vertical axis of the machine. The brake plate 124 and the brake shoes 120, 121 are carried by the wash basket 26 through a direct connection to the spin tube 60 which, in turn, is connected to rotate with the wash basket 26. Hence, the brake plate 124 and brake shoes 120, 121 rotate with the wash basket.

Each brake shoe 120, 121 includes an arcuate vertical wall 126 that faces the annular wall 112 of the drum 110 when assembled. Each arcuate wall 126 has an exterior surface 128 with a friction enhancing brake lining 130 attached and sandwiched between the wall 126 and the annular wall 112 of the drum. Respective mid sections 132 of the brake shoes 120 and 121 are each attached at the pivot 122 to the brake plate 124 and can move relative to the pivot and one another. Each shoe 120 and 121 has a first end 134 that are opposed and biased away from one another by a biasing element or mechanism such as a coil spring or compression spring 136. At rest, the spring 136 biases the first ends 134 away from one another forcing the brake lining 130 of each brake shoe into contact with the annular wall 112 of the brake drum 110. A second end 138 of each brake shoe includes a low-friction roller 140 attached to each shoe. The roller 140 rides against a cam surface as described below. In one embodiment, each roller 140 is a ball bearing roller or track roller pressed in to a portion of each shoe with a roll pin. Such ball bearing rollers provide very low friction contact surfaces that are highly durable providing a highly consistent or constant coefficient of friction over their useful life.

Prior washing machine brake assemblies typically used a steel roller with a pin passing through the roller. Each pin was zinc coated to provided a low-friction surface contact between the pin and roller. The zinc coating would wear quickly producing a significant increase in coefficient of friction for the roller over the useful life of the roller. Such increase in the coefficient of friction creates a significant and undesirable change in brake performance.

The present invention also includes a cam assembly generally includes a cam 152, a cam driver 154, and a slip sleeve 156. The cam 152 is received over the spin tube 60 and is free to rotate relative to the spin tube through an angle of less than 180°. A bushing 158 is received between the cam 152 and spin tube 60 and includes a flange 160 that extends between the cam and the brake plate 124. The cam 152 bears against the flange 160 and thus against the brake plate 124.

The cam 152 includes a pair of opposed cam surfaces 162 that have a particular gradual cam profile. The bearing rollers 140 on the second ends 138 of the brake shoes 120 and 121 bear against and ride along the cam surfaces 162 as described below. The cam 152 also includes a radial projection 164 that acts as a stop to limit travel of the bearing rollers 140 along the cam surfaces and to thus limit or control the amount of maximum brake pressure that is applied by the brake shoes against the drum 110 and to prevent further rotation of the cam 152 relative to the spin tube 60.

Figure 5:
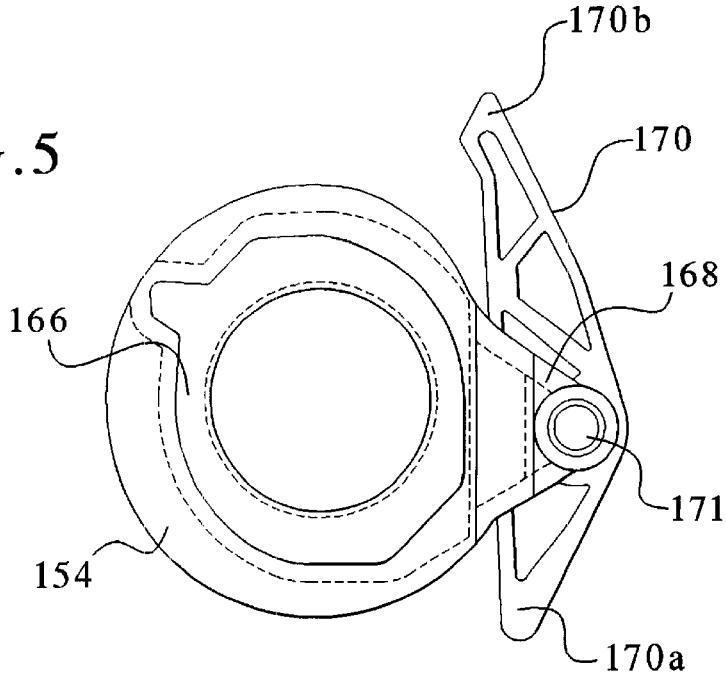
FIG. 5 is a top elevational view of the cam driver and pawl of the washing machine of FIG. 1.
Figure 6:
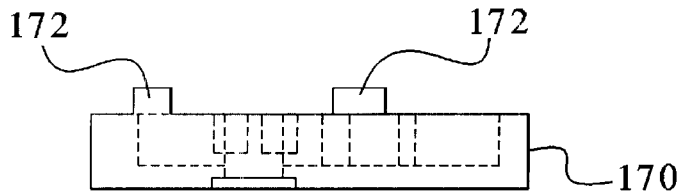
FIG. 6 is a side elevational view of the pawl of FIG. 5.
Figure 7:
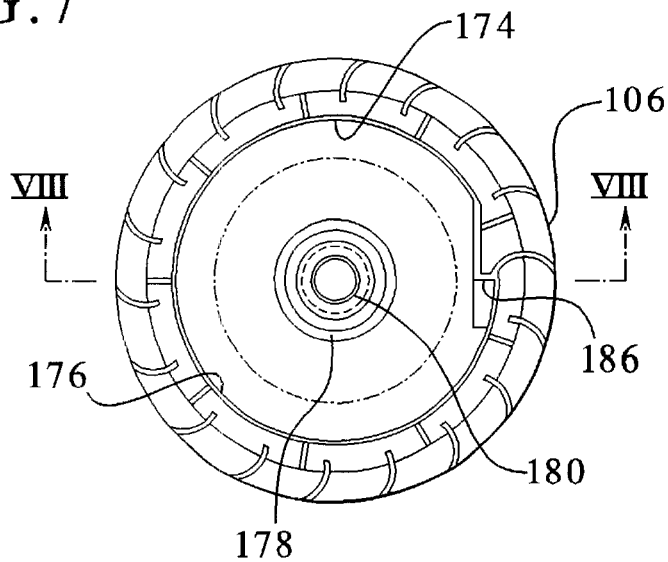
FIG. 7 is a top elevational view of the drive pulley of the washing machine of FIG. 1.

The cam driver 154 is shown in FIG. 5 and is an annular ring that is also received along the spin tube 60 and can also rotate freely relative to the spin tube. The cam driver 154 includes a recess 166 that has a shape corresponding to that of the cam 152. The cam driver 154 bears against a lower surface of the cam 152 and the cam seats within the recess 166. The cam driver 154 therefore moves the cam 152 in conjunction with movement of the cam driver. The cam driver 154 includes a lever 168 that extends radially outward from the driver. A pawl 170 is pivotally attached to the lever 168 by a pin 171 and can move relative to the lever through a predetermined angular range. A pair of stops 172 (FIG. 6) project upward from the pawl and bear against the lever 168 in order to limit the angular travel of the pawl.

Figure 8:
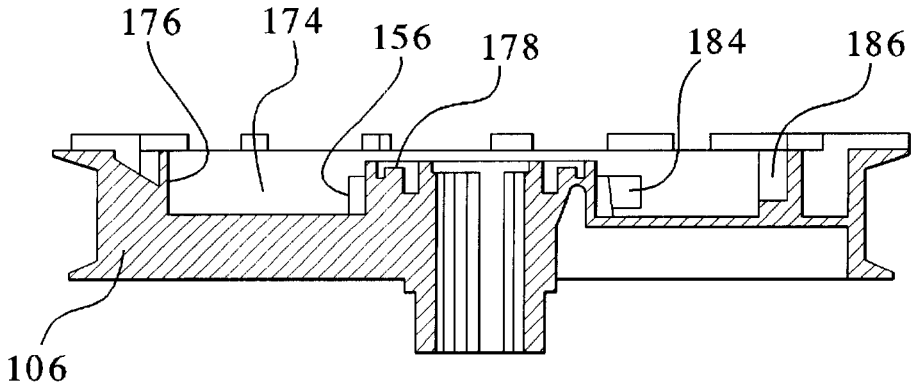
FIG. 8 is a side sectional view of the drive pulley taken generally along the line VIII—VIII in FIG. 7.

The axial pulley 106 is shown in sectional view in FIG. 8 and includes a recess 174 that faces the cam assembly 150. The pawl 170 is substantially positioned within the recess 174 of the axial pulley. The recess 174 is defined by an annular outer wall 176 that faces the recess. The axial pulley 106 also includes a hub 178 that also faces the cam assembly 150. The hub 178 has an upper face that includes a bearing 180 that rides against a bottom surface 182 of the cam driver 154. The axial pulley 106 and vertical shaft 62 rotate as one, and the bearing 180 provides a low-friction contact surface between the hub 178 and the spin tube 60.

Figure 9:
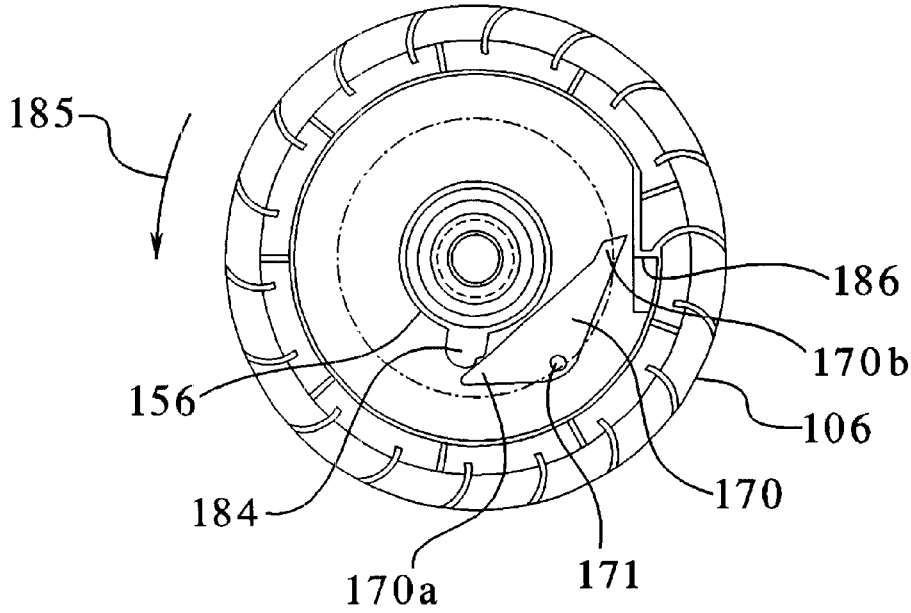
FIG. 9 is a top elevational view of the drive pulley and pawl where the drive pulley moves counter-clockwise relative to the output shaft.
Figure 10:
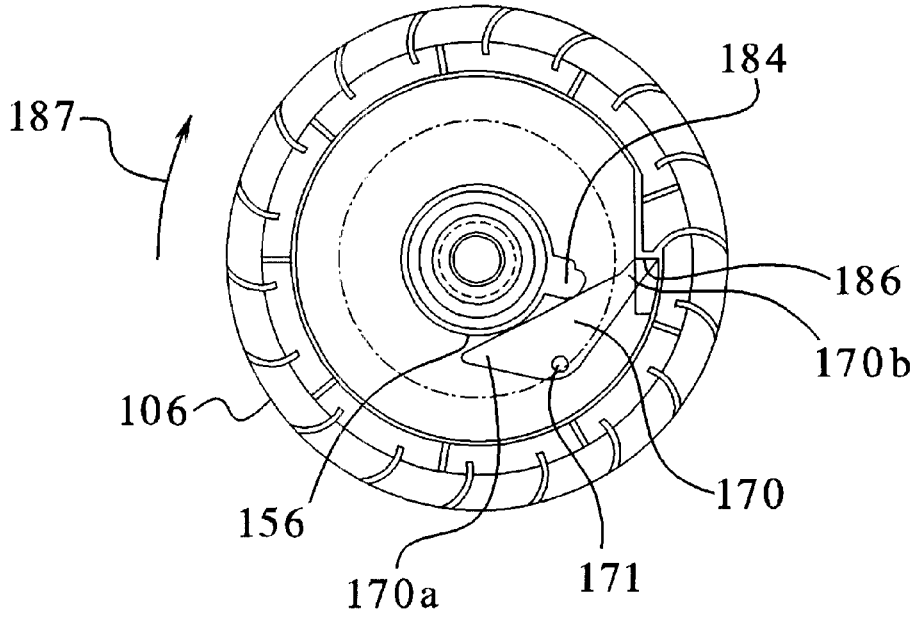
FIG. 10 is a top elevational view of the drive pulley and pawl where the drive pulley moves clockwise relative to the output shaft.

As shown in FIG. 8, the slip sleeve 156 is received around the hub 178 and is free to rotate around the hub. The slip sleeve 156 includes a lifter 184 extending radially outward from the sleeve. As illustrated in FIGS. 9 and 10, depending upon the rotation direction of the axial pulley 106 relative to the output shaft 62, both the slip sleeve 156 and lifter 184 will come in contact with one end or the other of the pawl 170 causing the pawl to rock or pivot around the pin 171 in one direction or the other until one of the stops 172 contacts the lever 168 of the driver 154.

During the spin mode, the motor 40 drives the drive pulley 106 which moves counter-clockwise relative to the initially stationary basket 26 and connected spin tube 60. Thus, the drive pulley 106 moves counter-clockwise relative to the cam driver 154 which is carried on the spin tube 60. This situation is illustrated in FIG. 10.

As shown in FIG. 10, when the axial pulley 106 rotates in a relative clockwise direction, as indicated by arrow 187, as compared to the pawl 170 which is carried by the cam driver, the lifter 184 will engage near a second end 170*b* of the pawl 170, causing the second end 170*b* to move outwardly and a first end 170*a* to move inwardly. This coupling mechanism causes a driving connection to occur between the motor 40 and the basket 26, and hence the motor and basket are coupled and the basket is caused to rotate at a speed determined by the speed of the motor.

When the drive pulley 106 rotates in a relative clockwise direction, as indicated by arrow 187 in FIG. 10, as compared to the pawl 170 which is caused by the cam driver, the lifter 184 will engage near the second end 170*b* of the pawl 170, causing the second end 170*b* to move outwardly and the first end 170*a* to move inwardly. A key or catch 186 is carried on the annular wall 176 within the recess 174 of the drive pulley 106. The catch 186 comprises a notch that corresponds in shape to the second end 170*b* of the pawl 170. The catch 186 catches the pawl 170 as described below which rotationally locks up the axial pulley 106 with the cam assembly 150 also as described below.

The torque of the motor 40, acting through the pawl 170 on the cam driver 154 causes the cam driver, and hence the cam 152, to rotate, causing the rollers 140 to ride on the cam towards a thicker profile, thus acting against the spring 136 and releasing the brake shoes 120, 121 from the annular wall 112 of the brake drum 110. When this occurs, and the rollers reach the end of their travel, the entire brake assembly, except the stationary brake drum 110, will begin to rotate, and hence the spin tube 60, to which the brake plate 124 and wash basket 26 are secured, will rotate.

When power to the motor 40 is terminated, the motor will begin to decelerate at a predetermined rate. This will cause the drive torque to no longer be applied through the drive pulley 106 and pawl 170 to the cam driver 154, hence allowing the power of the spring 136 to cause the rollers 140 to begin to move toward a thinner portion of the cam profile, and allowing the brake shoes 120, 121 to engage the brake drum 110.

If the wash basket 26 is heavily loaded, it will slow down more slowly than the motor 40, and the drive pulley 106, connected to the motor 40, will rotate counter-clockwise (as in FIG. 9) with respect to the spin tube which carries the cam driver 154 and pawl 170. As this happens, the lifter 184 will engage the first end 170*a* of the pawl 170 and will release the second end 170*b* from the catch 186. The motor 40 and wash basket 26 will then be uncoupled and will stop at their own rates.

If the wash basket 26 is lightly loaded, it will slow down more quickly than the motor. This will cause the drive pulley 106 to rotate clockwise with respect to the cam driver 154 and pawl 170 (FIG. 10). As this happens, the lifter 184 will engage the second end 170*b* of the pawl 170 and cause it to engage the catch 186, thereby coupling the motor and the wash basket. Since the brake, in this scenario, is causing the basket to slow more quickly than the motor, the motor will generate a reactive torque, which will be transmitted through the cam driver 154 to rotate the cam 152 and to release the brake, thereby reducing the brake torque and lengthening the time required to bring the wash basket to a complete stop.

Thus, in a heavily loaded basket condition, the motor and basket will be automatically uncoupled and the brake will be able to apply full braking torque on the basket to slow it down. On the other hand, in a lightly loaded basket condition, the motor and basket will be automatically coupled and the reaction torque of the motor will operate through the rotation of the cam to reduce the braking torque, thereby preventing jerking and movement of a lightly loaded washer. In this manner, the braking system automatically adapts to the mass of the load in the basket and effectively adjusts the braking torque in response to the size or mass of the load.

When viewed from above, as in FIG. 10, the drive pulley 106 rotates in a clockwise direction when the cam assembly locks up with the drive pulley and in a counter-clockwise direction, as in FIG. 10, when the drive pulley and vertical shaft 62 rotate independently of the spin tube, brake assembly and cam assembly components. When the drive system including the drive pulley 106 is rotated in a clockwise direction, the machine is operating in the spin cycle. The drive belt and pulley are rotated at a high RPM, such as for example, 500–800 RPM. The pawl 170 of the cam driver 154 is lifted by the lifter 184 of the slip sleeve 156. The second end 170*b* of the pawl 170 is received in the catch 186 to lock up the drive pulley 106 and the cam assembly 150. Torque provided by the motor is transmitted to the drive pulley 106. Since the cam assembly 150 is locked up with the drive pulley, the cam rollers 140 ride up or along the cam surfaces 162 which thus compresses the biasing element or spring 136. The brake shoe linings 130 are moved away from the brake drum 110 releasing the brake and permitting the wash basket to rotate freely at the high rate of speed. The amount of torque applied through the drive pulley determines how far up the cam surfaces that the cam rollers 140 move. The more torque applied by the motor, the further the cam 152 rotates and hence the further the cam rollers 140 move along the cam surfaces 162. The cam surfaces 162 are of a very low profile and therefore it will take longer than in previous constructions for the roller bearings 140 to ramp down when the motor torque is removed.

The compression force of the spring 136 and the profile geometry of the cam surfaces 162 determine the variability of the brake mechanism 64 of the present invention. A lightly loaded wash basket requires little motor torque applied in order to spin the basket at a high rate of speed. Much additional torque must be input by the motor to spin a heavily loaded basket. The low cam profile of the invention permits the cam to operate and release the brake at much lower motor input torques, and on the order of about 30% of the motor torque than was previously required to operate or release the brake mechanism.

Figure 11:
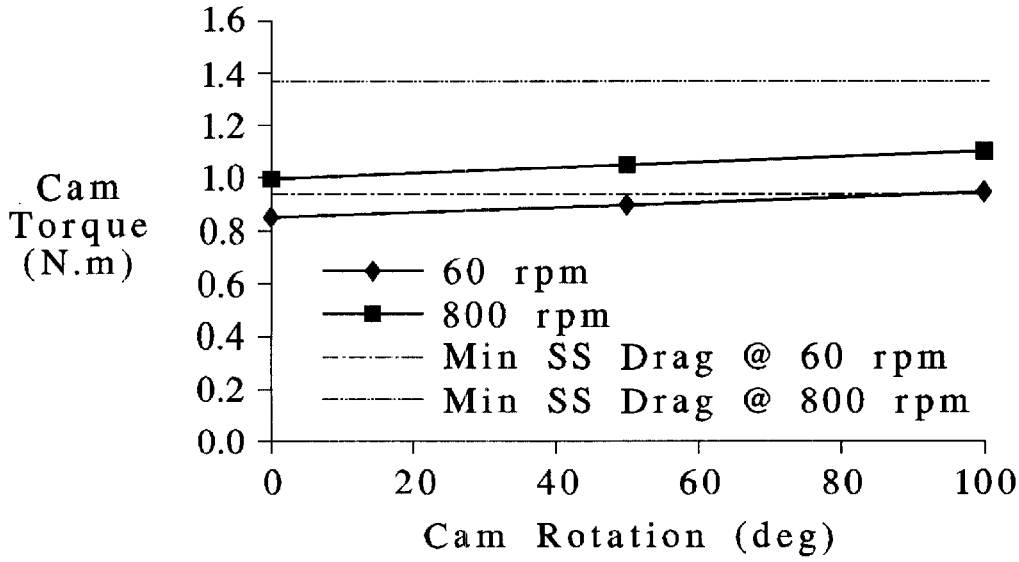
FIG. 11 is a graph representing cam torque plotted against cam rotation.

FIG. 11 illustrates a graph wherein cam torque is plotted against cam rotation in degrees. As can be seen, the brake mechanism releases the brake with only about 0.85 newton meters (Nm) of torque. When the brake cam operates at such low torque values, the brake cam can be actuated by the reaction torque of the motor armature when the motor decelerates from maximum spin speed to a stopped condition.

Figure 12:
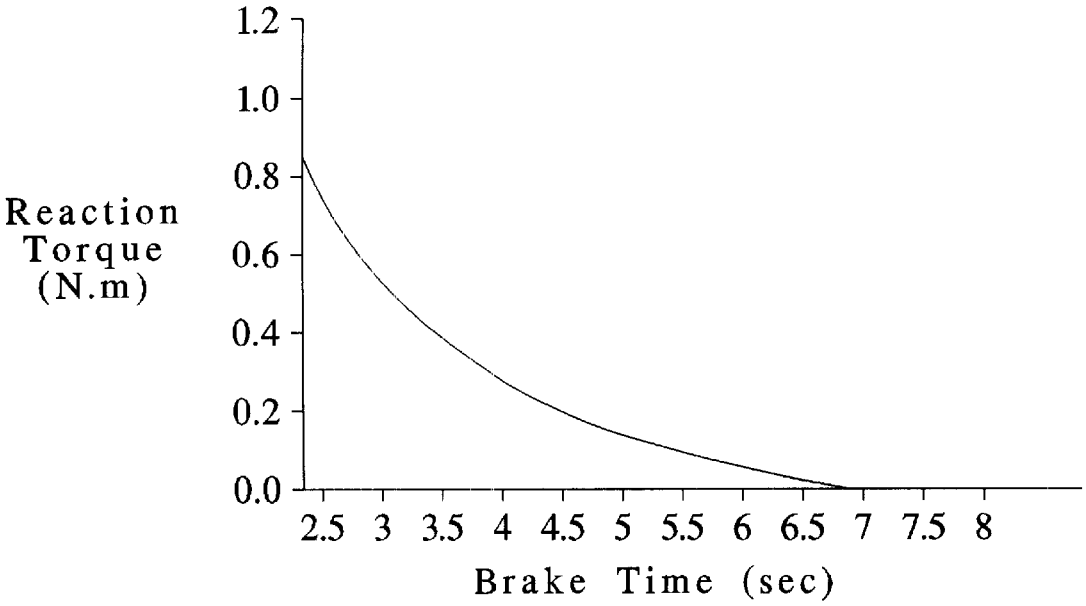
FIG. 12 is a graph representing motor reaction torque back into the cam through the motor armature plotted against the brake time.

FIG. 12 illustrates a graphic representation of motor representation of motor reaction torque input back into the brake cam through the motor armature against measured braking time. Motor reaction torque back into the brake cam dissipates over time. With prior art brake mechanism designs, motor reaction torque had little or no effect on brake pressure because a minimum of 2.5 newton meters of drive torque was required to release the brake. Thus, full brake pressure would be applied virtually from the instant the motor drive energy was stopped. In contrast, with the present invention, motor reaction torque is sufficient to act against the brake cam in order to partly relieve brake pressure. The graph shown in FIG. 12 illustrates the torque required to decelerate the motor armature as a function of the brake time. The longer the brake time, the lower the motor reaction torque. When a wash basket is fully loaded, the brake time will be long and in contrast, when the wash basket is lightly loaded the brake time will be short. For long brake times, the amount of motor reaction torque that is fed back into the brake cam is low enough that the motor reaction torque will not relieve or reduce braking pressure. Thus, full brake pressure is applied by the brake of the present invention. For a lightly loaded wash basket, the brake time is significantly shorter. When the brake time approaches 2.5 seconds or less, the motor reaction torque as can be seen in FIG. 12 becomes large enough to partly or completely balance against the brake spring force to at least partly disengage the brake and thus reduce braking pressure. This will extend the braking time. This phenomena produces an adaptable brake mechanism. When the wash basket is lightly loaded, the brake will therefore not fully apply and will prevent vibration, movement of the machine, and possible damage to the components.

Figure 13:
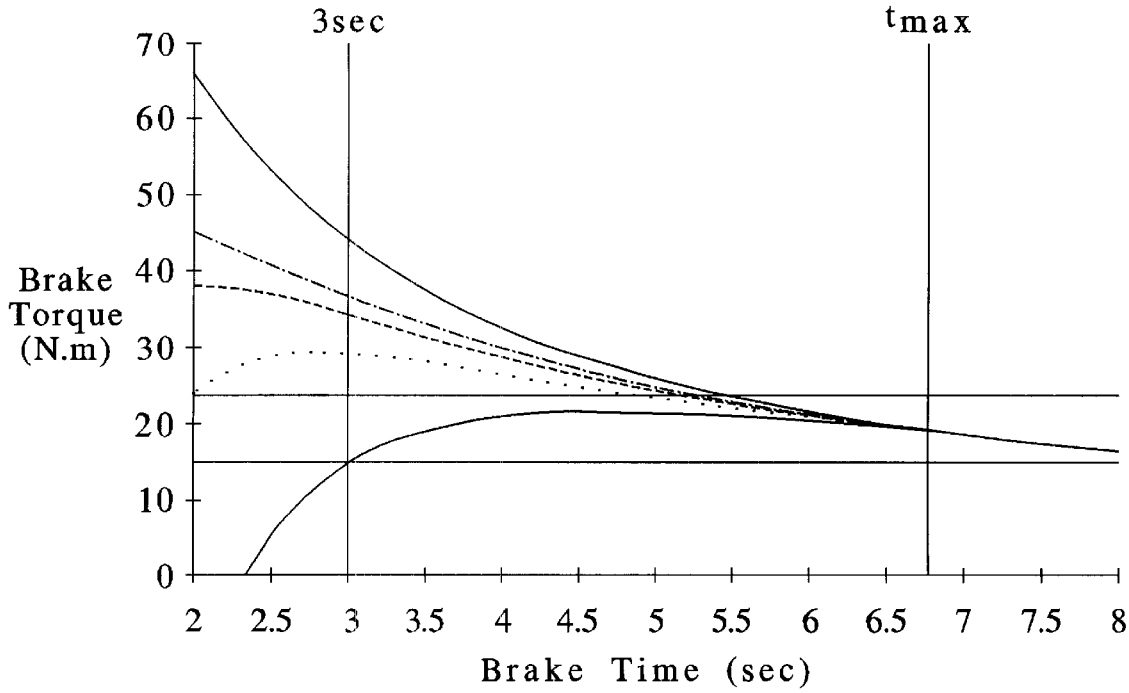
FIG. 13 is a graph representing various cam profiles wherein applied brake torque is plotted against brake time for various cam profiles.

FIG. 13 is a graphic representation of various cam profiles wherein brake torque is plotted against brake time. The upper curve shows brake torque that is applied by the braking mechanism versus braking time wherein no cam effect was utilized. The lower curve illustrates a brake cam of the present invention having a very low cam profile. The intermediate curves show cams having higher cam profiles. As can be seen upon a review of FIG. 13, applied brake torque is significantly reduced for short braking periods which represent light wash basket loads. This is the primary desired effect of the invention. The upper curve represents a brake mechanism with no cam effect and illustrates that the brake torque is very high for short braking times. This system with no cam effect would produce undesirable results such as system vibration and movement of the washing machine.

Figure 14:
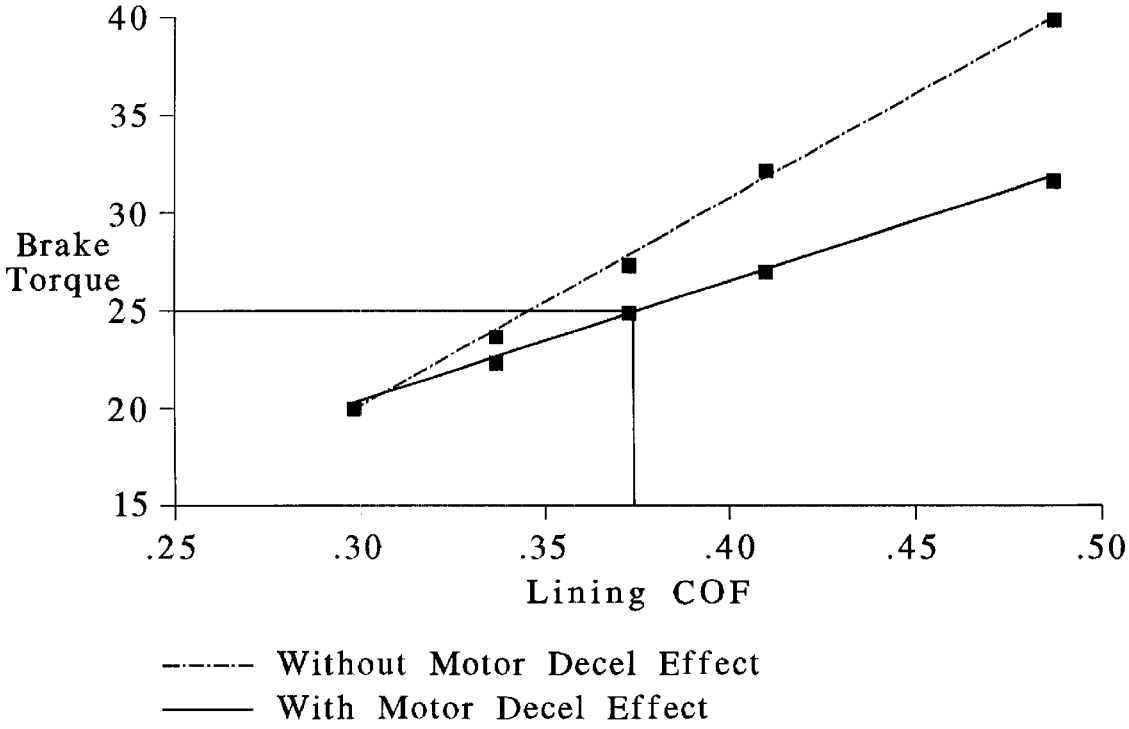
FIG. 14 is a graph representing overall brake sensitivity to brake lining coefficient of friction with and without utilizing the cam effect of the present invention wherein brake torque is plotted against brake pad lining coefficient of friction.

FIG. 14 is a graphic representation of overall braking sensitivity plotted against brake lining coefficient of friction. FIG. 14 includes two separate data groups, one representing a brake mechanism including the cam effect of the invention and a brake mechanism without the cam effect. Brake torque is actually plotted against brake lining coefficient of friction. As can be seen upon review of this figure, the effect of differences in brake lining coefficient of friction is reduced when a brake mechanism including the cam effect of the present invention is utilized. The upper graph illustrates a greater range of brake torque applied by the brake mechanism and represents a brake mechanism with no cam effect. A reduced differential brake torque is provided when a brake cam of the present invention is utilized for different brake linings.

The present invention is for a brake mechanism that includes a cam that releases and applies the brakes of the mechanism depending upon rotation of the cam. The cam is in turn rotated by applied motor torque. When the motor torque is released, residual deceleration torque from the motor armature has an effect on the return rotation of the cam. Residual motor torque is applied at the early stages of motor deceleration greater than at the latter stages. Therefore, when a light load of laundry is carried within the wash basket of the washing machine, the braking time is relatively short. However, because the residual motor torque acts to at least partly reduce the amount of braking pressure, the braking time is increased and the brake pressure is reduced at the beginning of the brake cycle. For heavier loads of laundry, the motor deceleration torque has little no effect on brake pressure.

The present invention has been described utilizing particular embodiments. As will be evident to those skilled in the art, changes and modifications may be made to the disclosed embodiments and yet fall within the scope of the present invention. The disclosed embodiments are provided only to illustrate aspects of the present invention and not in any way to limit the scope and coverage of the invention. The scope of the invention is therefore only to be limited by the appended claims.

The embodiments of the invention in which an exclusive property or privilege is claimed are defined as follows:

1. A load adaptive brake system for an appliance comprising:

a motor;

a drive wheel driven by said motor;

a rotatable vessel;

a brake surface fixed relative to a non-movable portion of said appliance;

at least one brake shoe carried by said vessel to rotate with said vessel;

a biasing mechanism engageable with said brake shoe to press said brake shoe into engagement with said brake surface;

a cam carried on said vessel, but rotatable with respect thereto, and engageable with a portion of said brake shoe to overcome a bias of said biasing mechanism when said cam is rotated relative to said vessel in a first direction to disengage said brake shoe from said brake surface; and a coupling mechanism arranged between said drive wheel and said cam to selectively couple said motor to said vessel by rotation of said cam in said first direction when said drive wheel is rotating in one direction relative to said cam and to uncouple said motor from said basket when said drive wheel is rotating in a second, opposite direction relative to said cam.

2. A load adaptive brake system according to claim 1, wherein said drive wheel comprises a pulley driven by said motor via a belt.

3. A load adaptive brake system according to claim 1, wherein said appliance comprises an automatic washer and said vessel comprises a clothes receiving basket.

4. A load adaptive brake system according to claim 1, wherein said brake surface comprises a brake drum surrounding said brake shoe.

5. A load adaptive brake system according to claim 1, wherein said at least one brake shoe comprises a pair of brake shoes.

6. A load adaptive brake system according to claim 5, wherein said biasing mechanism comprises a compression spring positioned between said pair of brake shoes.

7. A load adaptive brake system according to claim 6, wherein said brake shoes are pivotally mounted, each at a central portion thereof, and said spring, is positioned between opposing first ends of said brake shoes to bias said first ends apart and to bias second, opposite ends of said brake shoes towards one another.

8. A load adaptive brake system according to claim 7, wherein said cam is positioned between said second opposite ends of said brake shoes.

9. A load adaptive brake system according to claim 8, wherein said brake shoes each carry a roller thereon at their second end which engage against said cam.

10. A load adaptive brake system according to claim 1, wherein said biasing mechanism comprises a compression spring.

11. A load adaptive brake system according to claim 1, wherein said vessel includes a tube extending therefrom along an axis of rotation thereof, and said at least one brake shoe and said cam are mounted to said tube.

12. A load adaptive brake system according to claim 1, wherein said coupling mechanism comprises a pivotable pawl carried on a cam driver, said cam driver rotatable with said cam, a lifter slidingly carried on said wheel, and a catch detent provided at said wheel, whereby, when said wheel rotates in one direction relative to said cam, said lifter will engage a first end of said pawl and pivot it such that a second end will move into engagement with said catch causing said wheel and said cam to rotate together and when said wheel rotates in a second direction relative to said cam, said lifter will engage said second end of said pawl and pivot it such that said second end will move out of engagement with said catch to allow said cam and said wheel to rotate relative to one another.

13. A method for controlling a rotational speed of a vessel of an appliance, comprising the steps:

applying a braking force between a fixed portion of said appliance and said vessel to prevent said vessel from rotating;

applying power to a motor to rotate a drive shaft of the motor;

rotatingly driving a wheel through a connection between said drive shaft and said wheel;

providing a cam on said vessel in a manner where said cam is rotatable both with and relative to said vessel;

coupling said drive wheel to said cam to couple said motor to said vessel by rotation of said cam in a first direction of rotation when said drive wheel is rotating in said first direction relative to said cam;

releasing said braking force between said fixed portion of said appliance and said vessel upon rotation of said cam in said first direction of rotation, thereby permitting said motor to drivingly rotate said vessel;

uncoupling said drive wheel to said cam to uncouple said motor from said vessel by rotation of said cam in a second direction of rotation when said drive wheel is rotating in said second direction relative to said cam;

reapplying said braking force between said fixed portion of said appliance and said vessel upon rotation of said cam in said second direction of rotation, thereby retarding a rotational speed of said vessel.

14. A method according to claim 13, wherein said step of applying a braking force comprises pressing at least one brake shoe against a braking surface.

15. A method according to claim 13, including the step of rotating said cam with said vessel once said cam has rotated relative to said vessel through a predetermined angle of less than 180 degrees.

16. A load adaptive brake system for an automatic washer comprising:

a motor;

a drive pulley driven by said motor;

a rotatable basket;

a spin tube secured to and rotatable with said basket;

a brake drum fixed relative to an immobile portion of said washer;

at least one brake shoe carried by said spin tube to rotate with said wash basket;

a biasing mechanism engageable with said brake shoe to press said brake shoe into engagement with said brake drum;

a cam carried on said spin tube, but rotatable with respect thereto and engageable with a portion of said brake shoe to overcome a bias of said biasing mechanism when said cam is rotated relative to said spin tube to disengage said brake shoe from said brake drum; and a coupling mechanism arranged between said drive pulley and said cam to selectively couple said motor to said wash basket when said drive pulley is rotating in one direction relative to said cam and to uncouple said motor from said basket when said drive pulley is rotating in an opposite direction relative to said cam.

17. A load adaptive brake system according to claim 16, wherein said at least one brake shoe comprises a pair of brake shoes.

18. A load adaptive brake system according to claim 17, wherein said biasing mechanism comprises a compression spring positioned between said pair of brake shoes.

19. A load adaptive brake system according to claim 18, wherein said brake shoes are pivotally mounted, each at a central portion thereof, and said spring, is positioned between opposing first ends of said brake shoes to bias said first ends apart and to bias second, opposite ends of said brake shoes towards one another.

20. A load adaptive brake system according to claim 19, wherein said cam is positioned between said second opposite ends of said brake shoes.

21. A load adaptive brake system according to claim 20, wherein said brake shoes each carry a roller thereon at their second end which engage against said cam.

* * * * *